United States Patent [19]

Tomyn

[11] 4,227,071

[45] Oct. 7, 1980

[54] ELECTRONIC CURRENCY COUNTER

[76] Inventor: Dmytro Tomyn, 58 Stephenson Cres., Saskatoon, Sask., Canada, S7H 3L7

[21] Appl. No.: 940,632

[22] Filed: Sep. 8, 1978

[51] Int. Cl.[3] ..... G06M 9/00

[52] U.S. Cl. ..... 235/92 SB; 235/92 V; 235/92 DN; 250/560

[58] Field of Search ..... 235/92 SB, 92 V, 92 DN; 250/559, 560, 561, 209

[56] References Cited

U.S. PATENT DOCUMENTS

| | | | |
|---|---|---|---|
| 3,790,759 | 2/1974 | Mohan et al. | 235/92 V |
| 3,882,302 | 5/1975 | Deichmiller et al. | 235/92 DN |
| 3,968,364 | 7/1976 | Miller | 250/261 |
| 4,120,403 | 10/1978 | Stephanos | 250/560 |

*Primary Examiner*—Joseph M. Thesz
*Attorney, Agent, or Firm*—Daniel J. Tick

[57] ABSTRACT

A pocket-sized electronic currency counter counts a stack of paper currency via a light beam and a plurality of photoresponsive cells. A counter in a housing is electrically connected to the cells for counting the electrical signals produced thereby and an indicator electrically connected to the counter in the housing visually indicates the count of the counter.

2 Claims, 2 Drawing Figures

FIG. 1
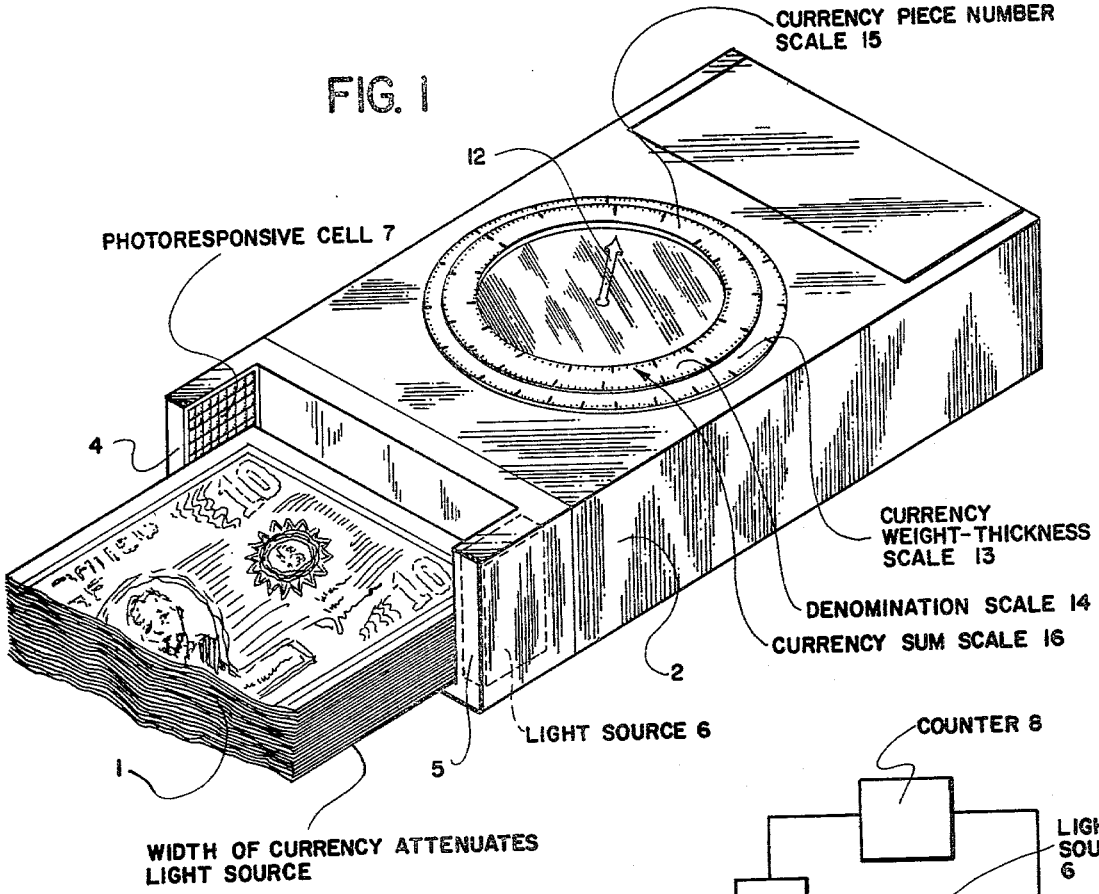
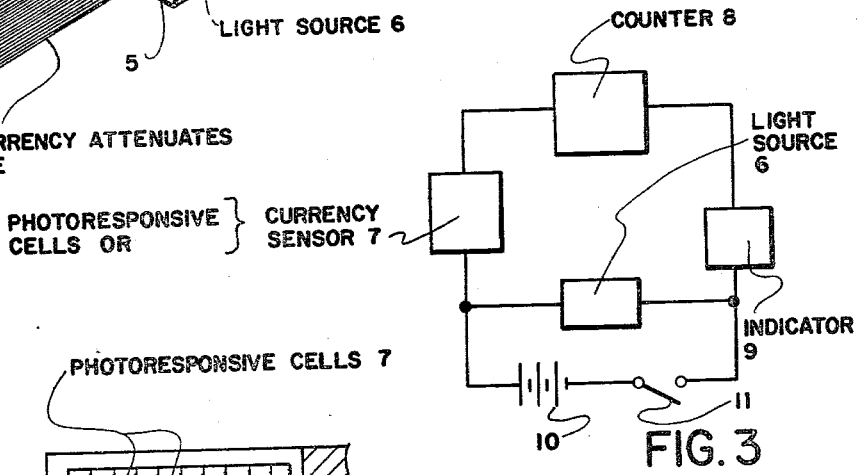
FIG. 3
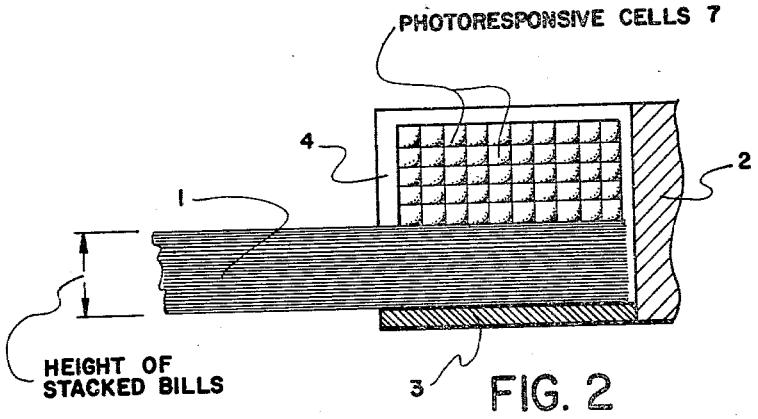
FIG. 2

ELECTRONIC CURRENCY COUNTER

BACKGROUND OF THE INVENTION

The present invention relates to an electronic currency counter. More particularly, the invention relates to an electronic currency counter for counting a stack of paper currency.

Electronic currency counters are disclosed in the following United States patents. U.S. Pat. No. 3,222,057, issued Dec. 7, 1965 to Couri, U.S. Pat. No. 3,447,655, issued June 3, 1969 to Tanaka et al, U.S. Pat. No. 3,487,905, issued Jan. 6, 1970 to James, Sr., U.S. Pat. No. 3,655,186, issued Apr. 11, 1972 to Bayha, U.S. Pat. No. 3,683,943, issued Aug. 15, 1972 to DeCrepy and U.S. Pat. No. 3,731,799, issued May 8, 1973 to Meloni et al.

Objects of the invention are to provide an electronic currency counter of simple structure, which is inexpensive in manufacture, readily and conveniently fits in a pocket or handbag, and functions efficiently, effectively and reliably to count a stack of paper money with considerable accuracy and great rapidity. The electronic currency counter of the invention also counts any stack of papers.

BRIEF DESCRIPTION OF THE DRAWINGS

In order that the invention may be readily carried into effect, it will now be described with reference to the accompanying drawings, wherein:

FIG. 1 is a perspective view of an embodiment of the electronic currency counter of the invention;

FIG. 2 is a view, on an enlarged scale, partly cutaway and partly in section, of the embodiment of FIG. 1; and FIG. 3 is a schematic block diagram of the embodiment of FIG. 1.

DETAILED DESCRIPTION OF THE INVENTION

The electronic currency counter of the invention counts a stack of paper currency 1 (FIGS. 1 and 2) of any denominations or of any sovereignty. The currency counter of the invention comprises a pocket-sized housing 2 (FIGS. 1 and 2) having a ledge 3 (FIG. 2) extending therefrom and bordered by a pair of spaced parallel side walls 4 and 5 (FIG. 1) perpendicular to the ledge 3 for accommodating one end part of a stack of paper currency 1, as shown in FIGS. 1 and 2.

A source of light 6 of any suitable type (FIG. 1) is mounted in the side wall 5 and comprises any suitable light source such as, for example, a lamp or plurality of lamps. The light source 6 provides a beam of light extending to the other side wall 4 and extending from the ledge 3 to the top of the side wall 4.

A plurality of photoresponsive cells 7 (FIGS. 1 and 2) of any suitable type are mounted on the other side wall 4 for receiving the beam from the source of light 6. The photoresponsive cells 7 are arranged in rows parallel to the ledge 3. Each of the rows of photoresponsive cells 7 is dimensioned to correspond to the thickness of a single piece of paper currency or any other type of paper which is being counted. The photoresponsive cells 7 function as a currency sensor 7 (FIG. 3) and produce an electrical signal for each row of cells obstructed, and therefore for each piece of paper currency.

A counter 8 of any suitable type (FIG. 3) in the housing 2 is electrically connected to the photoresponsive cells or currency sensor 7 and functions to count the electrical signals produced by said photoresponsive cells.

An indicator 9 of any suitable type (FIG. 3) is provided in the housing and is electricaly connected to the counter 8 for visually indicating the count of said counter.

A source of electrical energy 10 (FIG. 3) which may comprise any suitable battery or batteries, which may be rechargeable, is provided in the housing 2 and is electrically connected to the indicator 9 and the source of light 6, as shown in FIG. 3, whereby the source of light is energized to produce the aforedescribed beam of light. The indicator 9 thus functions to indicate the number of pieces of paper currency in the stack of currency 1.

An ON/OFF manually operated switch 11 is connected in the circuit shown in FIG. 3 to permit energization and deenergization of the electronic currency counter.

The indicator 9, as shown in FIG. 1, includes a pointer 12, a stack thickness scale 13, a currency denomination scale 14, a currency piece number scale 15 and a currency sum total scale 16. The user of the electronic currency counter of the invention may thus see, at a glance, what the result of the count is.

Any suitable light source, photoresponsive cells, counter, indicator and source of electrical energy known in the art may be used as the light source 6, the photoresponsive cells 7, the counter 8, the indicator 9 and the source of electrical energy 10, respectively. Such known components are described in United States Pat. No. 3,882,302, issued May 6, 1975 to Deichmiller et al.

While the invention has been described by means of a specific example and in a specific embodiment, I do not wish to be limited thereto, for obvious modifications will occur to those skilled in the art without departing from the spirit and scope of the invention.

I claim:

1. An electronic currency counter for counting a stack of paper currency, said currency counter comprising a pocket-sized housing having a ledge extending therefrom bordered by a pair of spaced parallel side walls perpendicular to the ledge forming an enclosure for accommodating at least one end part of a stack of paper currency;

a source of light in one of the side walls for providing light extending to the other of the side walls and illuminating said other of the side walls entirely, from the ledge to the top of said other side wall;

a plurality of photoresponsive cells on said other of said side walls for receiving the light from the source of light, said photoresponsive cells being arranged in rows parallel to said ledge, each of the rows of cells being dimensioned to correspond to the thickness of a single piece of paper currency, said photoresponsive cells functioning as a currency sensor and producing an electrical signal for each row of cells obstructed and therefore for each piece of paper currency resting on said ledge between said side walls;

counter means in the housing electrically connected to the cells for counting the electrical signals produced thereby;

indicating means in the housing electrically connected to the counter means for visually indicating the count of said counter means; and a source of electrical energy in the housing electrically connected to the indicating means and the source of light whereby said indicating means indicates the number of pieces of paper currency in the stack of currency resting on said ledge in said enclosure.

2. An electronic currency counter as claimed in claim 1, wherein said indicating means includes a pointer, a scale indicating stack thickness, a scale indicating currency denomination, a scale indicating currency piece number and a scale indicating currency sum total.

* * * * *